US010690425B2

(12) United States Patent
Cassels

(10) Patent No.: US 10,690,425 B2
(45) Date of Patent: Jun. 23, 2020

(54) FIREARM WITH LOCKED BREECH ROTATING BOLT PISTOL

(71) Applicant: Charles B. Cassels, New Smyrna Beach, FL (US)

(72) Inventor: Charles B. Cassels, New Smyrna Beach, FL (US)

( * ) Notice: Subject to any disclaimer, the term of this patent is extended or adjusted under 35 U.S.C. 154(b) by 0 days.

(21) Appl. No.: 15/852,091

(22) Filed: Dec. 22, 2017

(65) Prior Publication Data

US 2019/0195581 A1 Jun. 27, 2019

(51) Int. Cl.

| | |
|---|---|
| ***F41A 3/26*** | (2006.01) |
| ***F41A 3/30*** | (2006.01) |
| ***F41A 15/16*** | (2006.01) |
| ***F41A 9/41*** | (2006.01) |
| *F41A 15/14* | (2006.01) |

(52) U.S. Cl.

CPC ..... *F41A 3/26* (2013.01); *F41A 3/30* (2013.01); *F41A 9/41* (2013.01); *F41A 15/16* (2013.01); *F41A 15/14* (2013.01)

(58) Field of Classification Search

CPC ..... F41A 3/26; F41A 3/30; F41A 15/16

See application file for complete search history.

(56) References Cited

U.S. PATENT DOCUMENTS

| | | | |
|---|---|---|---|
| 4,244,273 | A | 1/1981 | Langendorfer, Jr. et al. |
| 5,726,377 | A | 3/1998 | Harris et al. |
| 5,941,005 | A | 8/1999 | Battaglia et al. |
| 6,829,974 | B1 | 12/2004 | Gwinn, Jr. |
| 6,971,202 | B2 | 12/2005 | Bender |
| 7,418,898 | B1 | 9/2008 | Desomma |
| 7,461,581 | B2 | 12/2008 | Leitner-Wise |
| 7,469,624 | B1 | 12/2008 | Adams |
| 7,610,844 | B2 | 11/2009 | Kuozynko et al. |
| 7,739,939 | B2 | 6/2010 | Adams |
| 7,856,917 | B2 | 12/2010 | Noveske |
| 7,891,284 | B1 | 2/2011 | Barrett |
| 7,934,447 | B2 | 5/2011 | Kuozynko et al. |
| 7,971,518 | B2 | 7/2011 | Adams |
| 8,161,864 | B1 | 4/2012 | Vuksanovich |
| 8,210,089 | B2 | 7/2012 | Brown |
| 8,307,750 | B2 | 11/2012 | Vuksanovich et al. |
| 8,316,756 | B1 | 11/2012 | Woodell et al. |
| 8,375,616 | B2 | 2/2013 | Gomez et al. |
| 8,387,513 | B2 | 3/2013 | Gomez et al. |
| 8,607,688 | B2 | 12/2013 | Cassels |
| 8,701,543 | B2 | 4/2014 | Brinkmeyer et al. |
| 8,813,632 | B2 | 8/2014 | Adams |
| 8,863,639 | B2 | 10/2014 | Gomez |
| 8,875,614 | B2 | 11/2014 | Gomez |
| 8,899,142 | B1 | 12/2014 | Cassels |
| 8,960,069 | B1 | 2/2015 | Soong et al. |
| 9,134,082 | B2 | 9/2015 | Brown |

(Continued)

*Primary Examiner* — J. Woodrow Eldred

(74) *Attorney, Agent, or Firm* — Carter, DeLuca & Farrell LLP

(57) ABSTRACT

A locked breech rotating bolt pistol caliber operating system for use with a semi-automatic or fully automatic firearms is described that is retro fit capable and is compatible with many existing AR15 type lower receivers that utilize pistol caliber magazines. The operating system includes an upper receiver that includes a fixed ejector to eject spent casings to minimize the likelihood that the firearm will jam.

23 Claims, 10 Drawing Sheets

(56) References Cited

U.S. PATENT DOCUMENTS

| | | | | |
|---|---|---|---|---|
| 9,459,060 | B2 | 10/2016 | Langevin et al. | |
| 9,459,061 | B2 | 10/2016 | Cassels | |
| 9,671,184 | B1 | 6/2017 | Russo | |
| 9,879,930 | B2 | 1/2018 | Cassels | |
| 9,903,675 | B2 | 2/2018 | Cassels | |
| 2003/0121444 | A1 | 7/2003 | Mutascio et al. | |
| 2005/0223613 | A1 | 10/2005 | Bender | |
| 2005/0262752 | A1* | 12/2005 | Robinson | F41A 3/26 42/71.01 |
| 2009/0031607 | A1 | 2/2009 | Robinson et al. | |
| 2009/0151213 | A1* | 6/2009 | Bell | F41A 19/15 42/69.03 |
| 2009/0229454 | A1 | 9/2009 | Fluhr | |
| 2010/0095834 | A1 | 4/2010 | Kuczynko et al. | |
| 2010/0151588 | A1 | 6/2010 | Angel et al. | |
| 2010/0199836 | A1 | 8/2010 | Herring | |
| 2010/0218671 | A1 | 9/2010 | Mayberry et al. | |
| 2010/0275769 | A1 | 11/2010 | Brittingham | |
| 2010/0275770 | A1 | 11/2010 | Noveske | |
| 2010/0282064 | A1 | 11/2010 | Bantle et al. | |
| 2011/0023699 | A1 | 2/2011 | Barrett | |
| 2011/0271827 | A1 | 11/2011 | Larson et al. | |
| 2012/0131834 | A1 | 5/2012 | Barrett et al. | |
| 2012/0131835 | A1 | 5/2012 | Barrett et al. | |
| 2012/0132068 | A1 | 5/2012 | Kucynko | |
| 2012/0137869 | A1 | 6/2012 | Gomez et al. | |
| 2012/0137872 | A1* | 6/2012 | Crommett | F41A 5/28 89/193 |
| 2012/0152104 | A1 | 6/2012 | Audibert et al. | |
| 2012/0152105 | A1 | 6/2012 | Gomez et al. | |
| 2012/0152106 | A1 | 6/2012 | Langevin | |
| 2012/0167757 | A1 | 7/2012 | Gomez | |
| 2012/0180354 | A1* | 7/2012 | Sullivan | F41A 3/26 42/16 |
| 2013/0055883 | A1 | 3/2013 | Cassels | |
| 2013/0284008 | A1 | 10/2013 | Pizano | |
| 2014/0060312 | A1 | 3/2014 | Ruck et al. | |
| 2014/0076143 | A1 | 3/2014 | Hall | |
| 2014/0076150 | A1 | 3/2014 | Brinkmeyer et al. | |
| 2014/0083286 | A1 | 3/2014 | Gomez | |
| 2014/0182450 | A1 | 7/2014 | Boutin, Jr. | |
| 2014/0190344 | A1 | 7/2014 | Kenney | |
| 2014/0224114 | A1* | 8/2014 | Faxon | F41A 15/14 89/193 |
| 2014/0260947 | A1 | 9/2014 | Gomez | |
| 2015/0253091 | A1 | 9/2015 | Gardner et al. | |
| 2015/0292825 | A1 | 10/2015 | Cassels | |
| 2016/0033219 | A1 | 2/2016 | Meier | |
| 2016/0209138 | A1 | 7/2016 | DeSomma | |
| 2016/0265860 | A1 | 9/2016 | Schilling et al. | |
| 2017/0160028 | A1 | 6/2017 | Martinez, Jr. et al. | |
| 2018/0142972 | A1* | 5/2018 | Overstreet | F41A 19/30 |

* cited by examiner

FIREARM WITH LOCKED BREECH ROTATING BOLT PISTOL

BACKGROUND

1. Technical Field

The present disclosure relates generally to semi-automatic or fully automatic firearms with pistol caliber gas operating systems and, more particularly, to semi-automatic or fully automatic firearms including locked breech rotating bolt pistol caliber operating systems.

2. Description of the Related Art

The development of pistol caliber operating systems for semi-automatic and fully automatic firearms dates back to the early 1900's when the term "submachine gun" was coined by John Thompson, the inventor of the Thompson submachine gun. The use of "sub guns", pistol caliber semi-automatic and fully automatic firearms continues today.

In the early 1980's with the continuing growth in popularity of the AR-15 in the United States and around the world, demand for a pistol caliber variant arose, specifically for a 9 mm Parabellum submachine gun. By 1982, Colt was producing what many would consider to be the most modern 9 mm sub caliber carbine/submachine gun of its time. However, Colt did not modernize the operating system and instead adapted the same blowback system dating back to the early 1900's.

There have been many AR-15 clones manufactured in nearly every pistol caliber including the 9 mm Parabellum, .40S&W, 10 mm Auto, .375 Sig, and 45ACP. Countless manufacturers of AR-15's since Colt have produced pistol caliber copies of the AR-15 yet none have modernized the pistol caliber operating system. There has been no real advancement in the operating systems of pistol caliber carbines/submachine guns since there advent in the early 1900's.

From their inception to present, pistol caliber operating systems have all used some variant of a blowback operating system to cycle the firearms action. Three major blowback type operating systems are the simple blowback, delayed/retarded blowback, and advanced primer ignition. Each of these systems operates without a fully locked breech. Without a fully locked breech, the blowback system must rely on an excessively heavy carrier and resistance from an action spring to slow the breech open until chamber pressure drops to a safe enough level to avoid injuring the shooter. This reliance on weight more than doubles the reciprocating weight of the carrier required with a locked breech system. This increased weight makes the firearm dramatically heavier and less controllable to operate. Even with the increased reciprocating weight, excessive bolt velocity during firing remains problematic and may result in failure of casing extraction, failures of ammunition feed, failure of the firearms action due to unburnt gun powder, accelerated wear and premature parts failure, out of battery round detonation, and exposure of the shooter to excessive amounts of discharge gases and noise.

The present disclosure offers many advantages over the prior art. More specifically, the presently disclosure is directed to a firearm including a locked breech pistol caliber operating system that utilizes a rotating bolt to fully lock the breech. This rotating bolt design slows the breech opening beyond what is possible with a blowback system and provides a greater degree of safety not possible with a blowback system. In circumstances where an overcharged round of ammunition or barrel obstruction is encountered, lugs of a rotating bolt inter-lock with lugs of a barrel extension of the firearm to prevent the bolt from accelerating at a dangerous velocity that can damage the firearm or cause serious injury to the shooter. The blowback system does not include a locking mechanism to prevent this situation. Because locked breech systems do not require a weighty bolt to provide inertia, the reciprocating weight of the bolt carrier can be reduced by more than half, making the firearm lighter and more controllable. In addition, the rotational locking and unlocking action of the bolt happens over distance to further delay the firearm's action. Delaying the firearm's action increases reliability of the firearm by reducing chamber pressure, slowing bolt velocity, burning propellant more completely, reducing fouling in the firearm's action, extracting spent casings more easily, reducing wear/parts failure, and exposing the shooter to less discharge gases and noise.

SUMMARY

One aspect of the disclosure is directed to a firearm having an upper receiver, a bolt carrier assembly, and an ejector. The upper receiver includes an internal wall defining a bore and an ejection port communicating with the bore. The bolt carrier assembly includes a bolt carrier and a bolt and is movable within the bore of the upper receiver between rearward-most and forward-most positions. The bolt is supported on the bolt carrier for axial and rotatable movement in relation to the bolt carrier and has a forward end including one or more first locking lugs. The upper receiver supports one or more second locking lugs adjacent a forward end of the receiver. The bolt is rotatable in relation to the bolt carrier from an unlocked position to a locked position in which the one or more first locking lugs are interlocked with the one or more second locking lugs. The ejector is fixedly supported within the bore of the upper receiver and has an angled forward face that is positioned to eject spent casings towards the ejection port of the upper receiver.

In embodiments, the firearm includes a barrel supported on a forward end of the upper receiver, wherein the barrel has a rearward end supporting the one or more second locking lugs.

In some embodiments, the bolt carrier assembly includes a cam pin, the bolt defines a cam pin bore, and the bolt carrier defines a cam pin slot, wherein the cam pin extends through the cam pin bore and the cam pin slot to couple the bolt to the bolt carrier.

In certain embodiments, the cam pin bore is configured to fixedly receive the cam pin and the cam pin slot is configured to allow axial and transverse movement of the cam pin within the cam pin slot such that movement of the cam pin through the cam pin slot causes the bolt to move axially and rotatably in relation to the bolt carrier.

In embodiments, the firearm includes a gas block supported on the barrel, a gas plug, and an piston op-rod. The piston op-rod includes a piston and a rod extending rearward from the piston. The gas block defines a gas plug bore and a barrel bore, wherein the barrel is received within the barrel bore, the piston of the piston op-rod is received in a rearward end of the gas plug bore, and the gas plug is received within a forward end of the gas plug bore such that the rod extends from the piston of the piston op-rod and engages the bolt carrier assembly.

In some embodiments, the barrel defines a gas aperture and the gas block defines a gas port that extends between the gas plug bore and the barrel bore and registers with the gas aperture.

In certain embodiments, the piston of the piston op-rod and the gas plug define a chamber within the gas plug bore and the gas port communicates with the chamber, wherein discharge gases produced by firing a round of ammunition from the firearm flows from the barrel, through the gas aperture and the gas port into the chamber to cause rearward movement of the piston op-rod and corresponding rearward movement of the bolt carrier assembly.

In embodiments, gas rings are supported about the gas plug and the piston of the op-rod to provide a hermetic seal between the gas plug and piston and the gas block bore.

In some embodiments, the gas block defines a slot and the gas plug defines a boss that is received within the slot to couple the gas plug to the gas block.

In certain embodiments, the slot is configured to rotatably receive the boss.

In embodiments, the gas block slot defines a detent hole and the gas plug supports a detent assembly including a detent that is received within the detent hole to retain the boss within the slot.

In some embodiments, the barrel includes a barrel extension that defines a chamber. The barrel extension extends from the barrel and is secured to the upper receiver, wherein the one or more second locking lugs are supported within the barrel extension.

In certain embodiments, the bolt includes a feed lug and the firearm further includes pistol caliber magazine, wherein the feed lug is positioned to strip an upper most round of ammunition from the pistol caliber magazine and deliver the upper most round to the chamber.

In embodiments, the feed lug has a tapered rear surface that is positioned to engage and pass over the upper most round of ammunition during rearward movement of the bolt within the bore of the upper receiver.

In some embodiments, the bolt carrier defines a longitudinal axis and the tapered rear surface of the feed lug defines an angle β with the longitudinal axis, wherein β is between about 15 degrees and about 45 degrees.

In certain embodiments, β is between about 25 degrees and about 35 degrees.

In embodiments, β is about 30 degrees.

In some embodiments, the bolt carrier of the bolt carrier assembly includes a round guide that is positioned to engage a round of ammunition within the pistol caliber magazine supported on the firearm.

In certain embodiments, the bolt carrier includes mag cuts to allow the bolt carrier to clear the pistol caliber magazine during movement of the bolt carrier assembly between its forward most and rearward most positions.

In embodiments, the bolt and the bolt carrier include a longitudinal slot positioned to receive the ejector during movement of the bolt carrier assembly between its forward most and rearward most positions.

In some embodiments, the bolt defines an ejector pocket that is configured to receive the ejector when the bolt is rotated to the locked position to facilitate rotation of the bolt within the bore of the upper receiver to the locked position.

In certain embodiments, the barrel extension includes a feed ramp that works in conjunction with the feed lug of the bolt to strip rounds of ammunition from the pistol caliber magazine and direct the rounds into the chamber.

Another aspect of the present disclosure is directed to a bolt carrier assembly including a bolt carrier and a bolt. The bolt is supported on the bolt carrier for axial and rotatable movement in relation to the bolt carrier. The bolt has a feed lug and a forward end including one or more locking lugs. The feed lug includes a forward surface and a tapered rear surface. The forward surface is positioned to strip an upper most round of ammunition from a pistol caliber magazine of a firearm. The tapered rear surface is positioned to engage and pass over the upper most round of ammunition during rearward movement of the bolt within the bore of the upper receiver. The bolt carrier defines a longitudinal axis and the tapered rear surface of the feed lug defines an angle β with the longitudinal axis, wherein β is between 15 degrees and 45 degrees.

In embodiments, the forward surface of the feed lug has a chamfered lower edge having a radius of curvature of from about 0.020 of an inch to about 0.040 of an inch.

One aspect of the present disclosure is directed to a locked breech rotating bolt pistol caliber operating system for use with a semi-automatic or fully automatic firearm. The operating system includes a gas block having two gas block bores, the first to receive a barrel of the firearm and the second to receive a piston op-rod and gas plug. A gas port is defined within the gas block bore. The gas port communicates with the first and second gas block bores and is positioned to communicate with a gas port aperture of the firearm. A piston op-rod includes a piston that and is dimensioned to be received within the second gas block bore and extend through an upper receiver of the firearm to interface with a bolt carrier. A gas plug is dimensioned to be received within the second gas block bore in communication with the piston. The gas plug defines a plug that is fitted with a boss, a boss detent, and gas rings to hermetically seal the gas plug within the second gas block bore. The gas plug is retained within the gas block by a boss about its periphery that releasably locks into a gas block slot defined in the gas block. The gas block slot has a detent hole that is positioned to receive the gas plug detent. The gas plug boss houses the gas plug detent. The gas plug detent is spring loaded to secure the gas plug detent within the detent hole to prevent the gas plug boss from rotating free of the gas block slot. When the gas plug and the piston of the piston op-rod are secured in the second gas block bore, the piston and the gas plug define a chamber that communicates with a gas port aperture of the firearm. Upon firing a round of ammunition, a portion of high pressure gas is directed through the gas port aperture of the firearm and impinges upon the piston of the piston op-rod to drive the piston op-rod rearward and actuate a carrier. As the carrier moves rearward, a bolt supported on the carrier is rotated to unlock lugs of the bolt from barrel extension lugs of the barrel of the firearm. Continued rearward movement of the bolt pulls a spent case free from the chamber and ejects the spent case from the upper receiver. Once the carrier has reached full throw, the carrier is returned to battery by a recoil spring. As the carrier moves forward, the bolt strips a live round of ammunition from a magazine of the firearm and carries the live round into a chamber of the firearm. The bolt lugs again rotate and interlock with the barrel extensions lugs to complete the cycle.

BRIEF DESCRIPTION OF THE DRAWINGS

Various embodiments of the presently disclosed locked breech rotating bolt pistol caliber operating system for semi-automatic or fully automatic firearms is disclosed herein with reference to the drawings wherein.

DETAILED DESCRIPTION OF EMBODIMENTS

Figure 1:
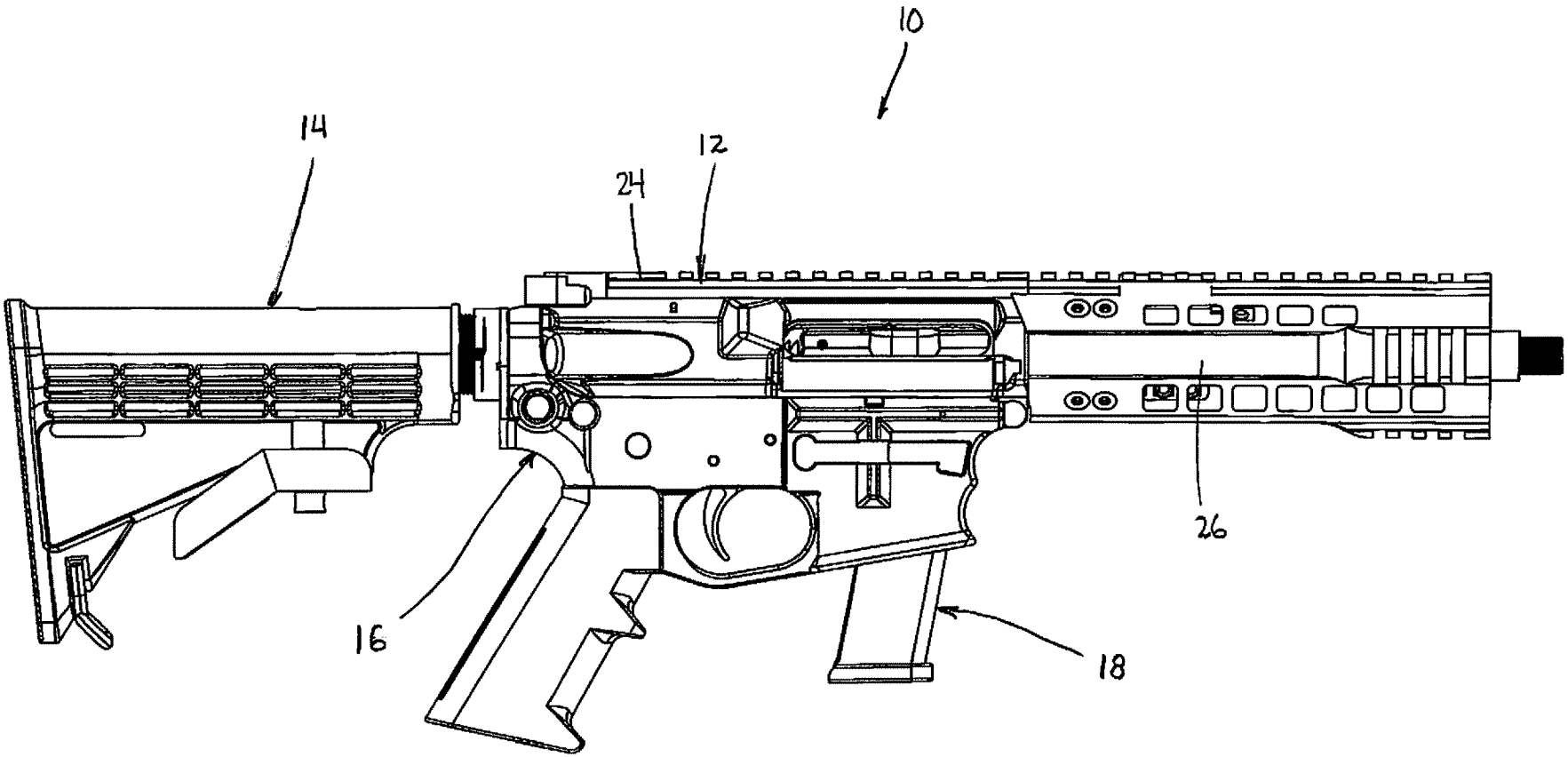
FIG. 1 is a side view of a firearm including an exemplary embodiment of a locked breech rotating bolt pistol caliber operating system.

Embodiments of the presently disclosed semi-automatic or fully automatic firearm including a locked breech rotating bolt pistol caliber operating system will now be described in detail with reference to the drawings wherein like reference numerals designate identical or corresponding elements in each of the several views.

The detailed description set forth below in connection with the appended drawings is intended as a description of selected embodiments of the disclosure and is not intended to represent the only forms in which the present embodiments may be constructed and or utilized. The description sets forth the functions and the sequence of steps for constructing and operating the selected embodiments. However, it is to be understood that the same or equivalent functions and sequences may be accomplished by different embodiments that are also intended to be encompassed within the spirit and scope of this disclosure.

Exemplary embodiments of the present disclosure are shown in FIGS. 1-8. FIG. 1 illustrates one exemplary embodiment of the presently disclosed firearm 10 including a locked breech rotating bolt pistol caliber operating system shown generally as operating system 12 (FIG. 2B). In embodiments, the firearm 10 includes an adjustable stock 14, a lower receiver 16, a clip or magazine 18, and the operating system 12.

Figure 2A:
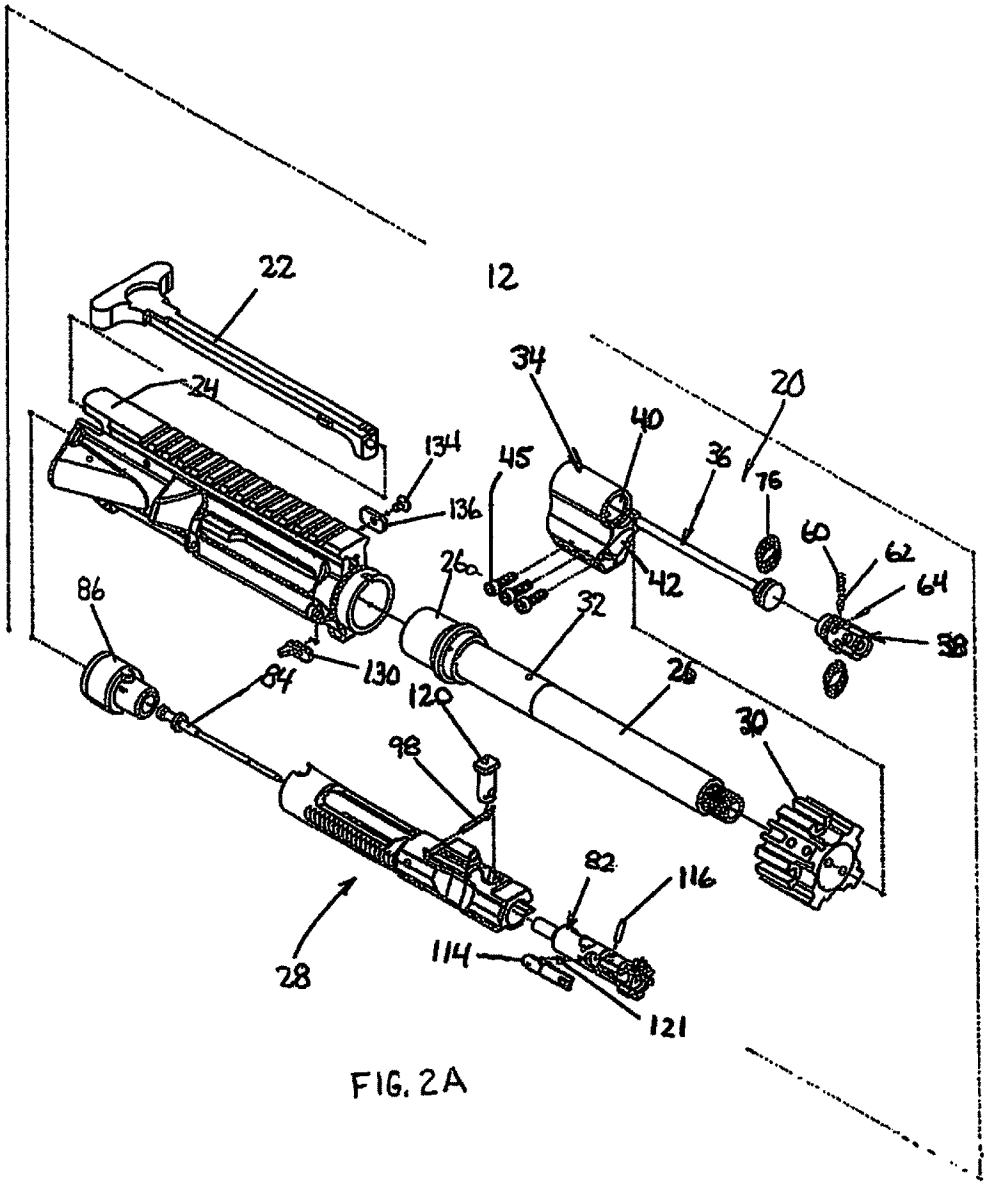
FIG. 2A is an exploded perspective view of one exemplary embodiment of the locked breech rotating bolt pistol caliber operating system of the firearm of FIG. 1.
Figure 2B:
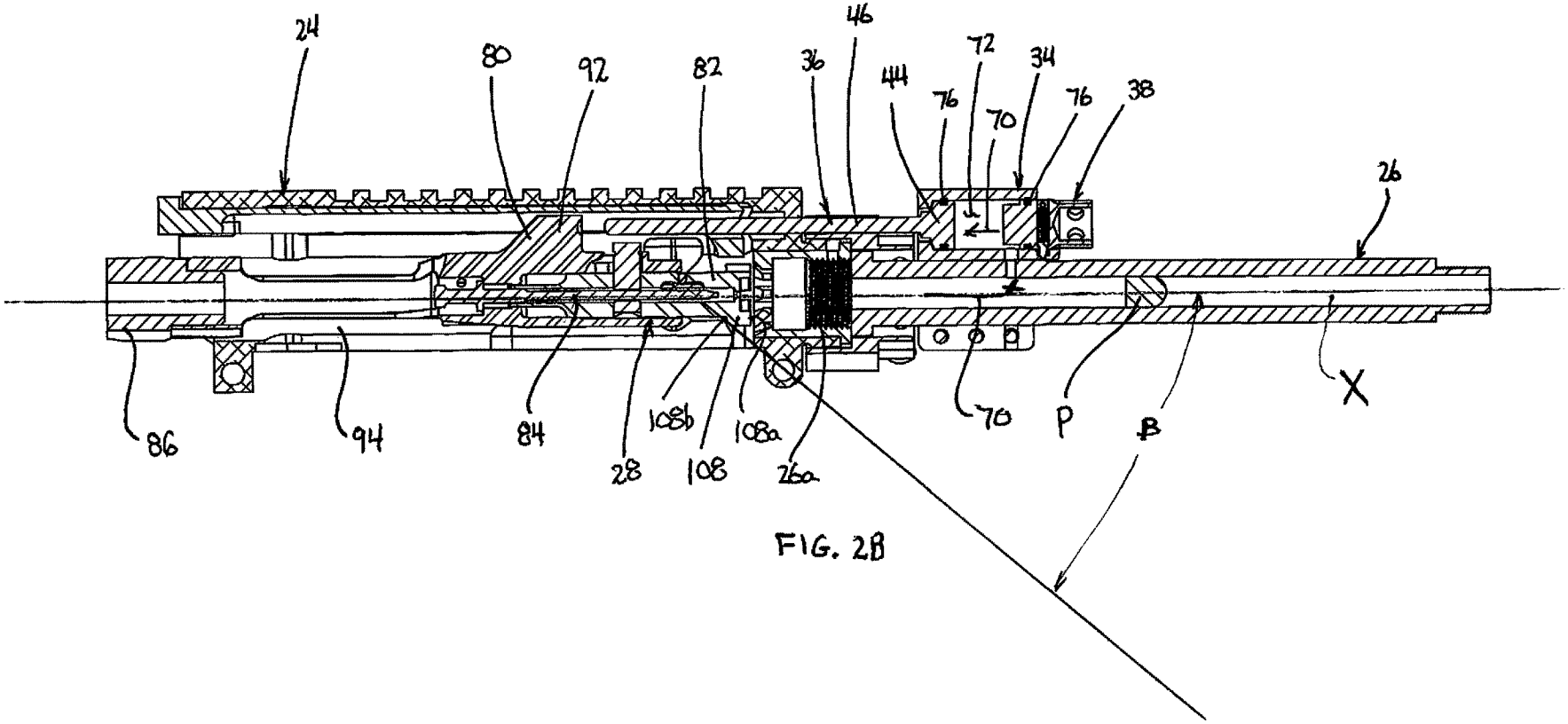
FIG. 2B is an assembled side cross-sectional view of the locked breech rotating bolt pistol caliber operating system of FIG. 2.

Referring to FIGS. 2A and 2B, the operating system 12 includes a gas block assembly 20, a charging handle 22, an upper receiver 24, a barrel 26 including a rearward extension 26*a*, a bolt carrier assembly 28, and a barrel nut 30. The barrel nut 30 is received about the barrel 26 and includes internal threads configured to secure the barrel 26 to a forward end of the upper receiver 24. The barrel 26 defines a gas aperture 32. The function and operation of the charging handle 22 is well known in the art and will not be described in further detail herein.

Figure 3:
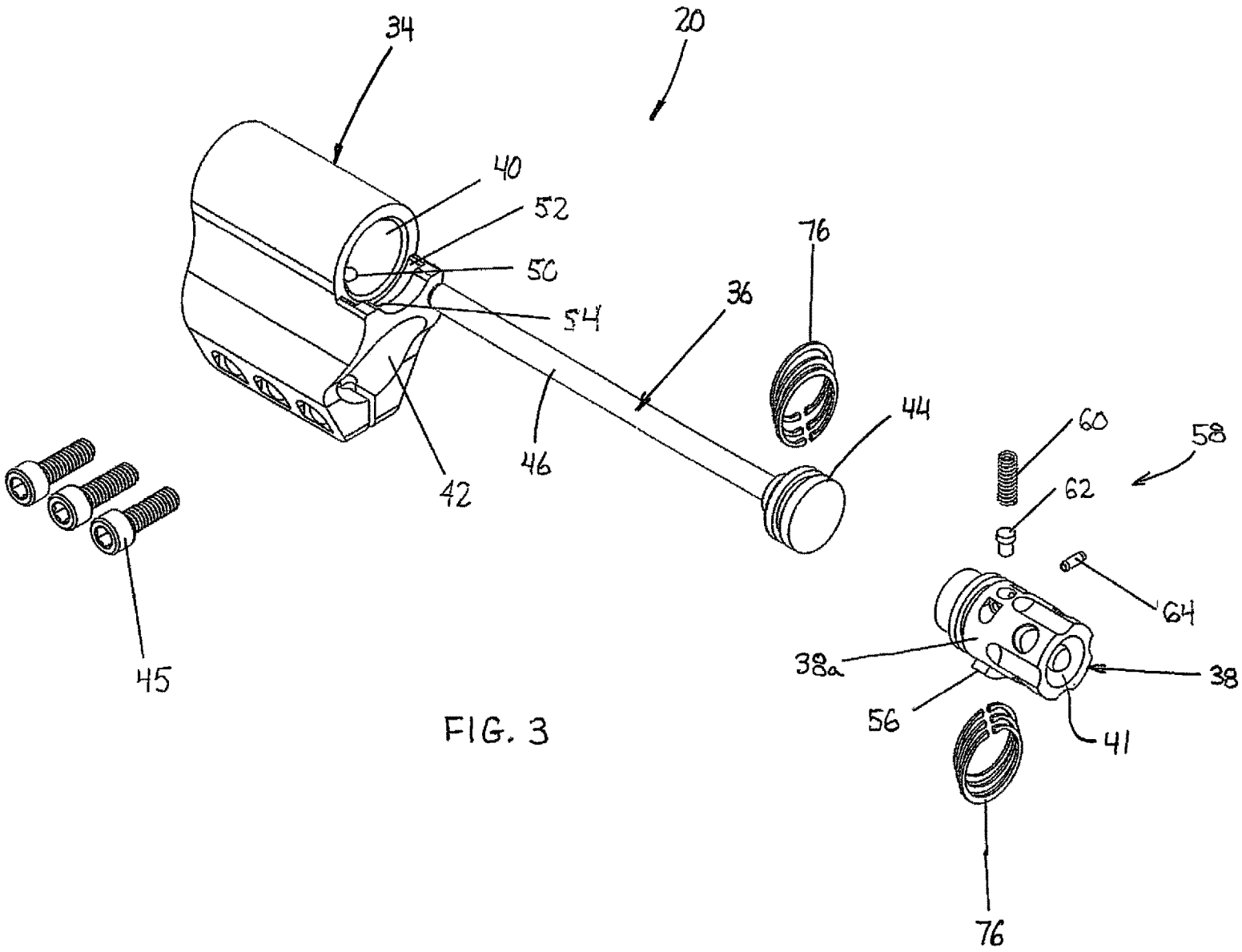
FIG. 3 is an exploded view of the gas block assembly of the operating system shown in FIG. 1.

Referring also to FIG. 3, the gas block assembly 20 includes a gas block 34, a piston op-rod 36 and a gas plug 38. The gas block 34 defines a gas plug bore 40 and a barrel bore 42. The piston op-rod 36 has a forward end defining a piston 44 and a rod 46 that extends rearwardly from the piston 44. The piston 44 of the piston op-rod 36 is slidably positioned within the gas plug bore 40 of the gas block 34 such that the rod 46 of the piston op-rod 36 extends from a rearward end of the gas plug bore 40 and engages the bolt carrier assembly 28 as is known in the art. The gas block 34 defines a gas port 50 that extends between the gas plug bore 40 and the barrel bore 42 of the gas block 34. The gas block 34 includes a forward end that defines a circular slot 52 having a detent hole 54 (FIG. 3.) The gas block 34 can be secured about the barrel 26 using clamp screws 45 although other securement techniques may also be used The gas plug 38 is rotatably received within a forward end of the gas plug bore 40 and includes a body 38*a* including a boss 56. The boss 56 is configured to be rotatably received within the circular slot 52 of the gas block 34 to secure the gas plug 38 within the gas plug bore 40. The gas plug 38 supports a detent assembly 58 including a detent spring 60, a detent 62 and a detent pin 64. The detent assembly 58 is supported on the gas plug 38 such that the detent 62 is urged into the detent hole 54 of the gas block 34 when the gas plug 38 is rotatably attached to the gas block 34 to rotatably retain the boss 56 of the gas plug 38 within the circular slot 52 of the gas block 34.

The barrel bore 42 of the gas block 34 is configured to receive the barrel 26 of the firearm 10 such that the gas port 50 of the gas block 34 registers with the gas aperture 32 of the barrel 26 (FIG. 2A). When a round (FIG. 2B) is fired from the firearm 10 (FIG. 1), a bullet or projectile "P" is propelled by discharge gases 70 down the barrel 26. After the projectile "P" passes by the gas aperture 32 of the barrel 26, a portion of the discharge gases 70 is directed through the gas aperture 32, through the gas port 50 of the gas block 34, and into a chamber 72 of the gas plug bore 40 where the discharge gases 70 exert a force that drives the piston 44 of the piston op-rod 36 rearwardly. As discussed above, the rod 46 of the piston op-rod 36 is engaged with the bolt carrier assembly 28 such that rearward movement of the piston op-rod 36 causes rearward movement of the bolt carrier assembly 28 within the upper receiver 24 (FIG. 2A). As shown in FIG. 3, the piston 44 and the gas plug 38 may support sealing rings 76 that hermetically seal the area between the piston 44 and gas plug body 38*a* and the gas block 34.

Referring to FIGS. 2B and 4A-5, the bolt carrier assembly 28 includes a bolt carrier 80, a bolt 82, a firing pin 84, and a buffer 86. The bolt carrier 80 defines a longitudinal bore 80*a*, a cam pin slot 88, a longitudinal ejector slot 90, a carrier lug 92, a hammer slot 94, and a retaining pin bore 96. The retaining pin bore 96 receives a retaining pin 98 (FIG. 4B). The longitudinal bore 80*a* slidably and rotatably receives the bolt 82 as described in further detail below. The function and operation of the firing pin 84, buffer 86, hammer slot 94, retaining pin bore 96, and retaining pin 98 are known in the prior art and will not be described in further detail herein.

The bolt 82 includes a body 100 that defines a longitudinal ejector slot 102, an ejector pocket 102*a*, and a cam pin bore 106. The forward end of the body 100 of the bolt 82 includes a feed lug 108 and one or more locking lugs 110. The feed lug 108 has a forward surface 108*a* and a rear surface 108*b*. In embodiments, the forward surface 108*a* has a bottom edge that is slightly chamfered or radiused. For example, the bottom edge can define a radius of between about 0.020 of an inch and about 0.040 of an inch. In some embodiments, the radius of curvature is about 0.032 of an inch although other radiuses of curvature are envisioned. The rear surface 108*b* of the feed lug 108 extends downwardly from the bolt 82 and is tapered to facilitate smooth passage of the feed lug 108 over an upper most round of ammunition within a magazine 18 (FIG. 8) of the firearm 10. In embodiments, the rear surface 108*b* defines an angle β (FIG. 2B) with the longitudinal axis "X" of the bolt carrier 80. In embodiments, β is between about 15 degrees and 45 degrees. In other embodiments, β is between about 25 degrees and 35 degrees. In other embodiments, β is about 30 degrees. In some embodiments, the bolt 80 includes five locking lugs 110 although any number of locking lugs 110 can be included on the bolt 82. The body 100 of the bolt 82 also defines an extractor pocket 112 (FIG. 4A) that receives an extractor 114. The extractor 114 is pivotally supported within the extractor pocket 112 by a pivot member 116 and includes a forward end that defines an inwardly extending rib 118. The rib 118 is configured to engage and grip a rim (not shown) of a casing of a spent round of ammunition to return the casing rearward towards an ejector 130 as described in detail below. A spring 121 is positioned to pivot the extractor 114 about the pivot member 116 to urge the rib 118 inwardly towards a longitudinal axis "X" (FIG. 4A) of the bolt carrier assembly 28.

The cam pin bore 106 of the bolt 82 and the cam pin slot 88 of the bolt carrier 80 receive a cam pin 120. In embodiments, the cam pin 120 is substantially cylindrical and includes a recess 122. The recess 122 provides clearance for an ejector 130 (FIG. 5) to allow for movement of the cam pin 120 in relation to the ejector 130 within the longitudinal bore 80*a* of the bolt carrier 80. The cam pin 120 is fixedly received within the cam pin bore 106 of the bolt 82 but axially and transversely movable within the cam pin slot 88 of the bolt carrier 80 to facilitate rotatable and axial movement of the bolt 82 in relation to the bolt carrier 80.

Figure 5:
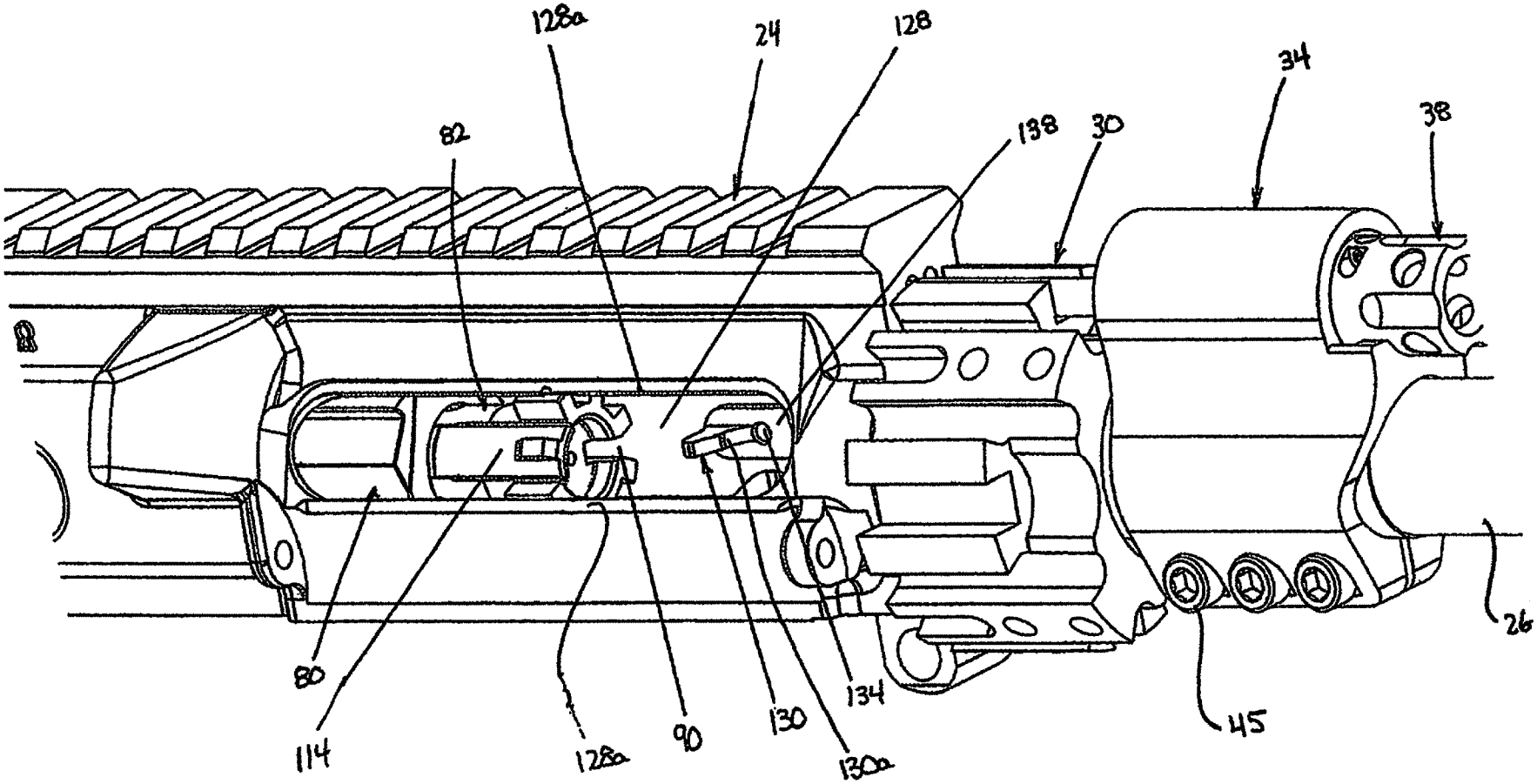
FIG. 5 is an enlarged, top, perspective view of the operating system shown in FIG. 2 illustrating an interface between the bolt and an ejector of the firearm of FIG. 1.

Referring to FIGS. 2A and 5, the upper receiver 24 defines a receiver bore 128 and an ejection port 128*a*. The receiver bore 128 receives the bolt carrier assembly 28. The upper receiver 24 supports a fixed ejector 130 that is supported on an internal wall of the upper receiver 24 and includes a curved or angled forward surface 130*a* (FIG. 5) that extends upwardly towards the ejection port 128*a* of the upper receiver 24. In embodiments, the fixed ejector 130 is secured to the upper receiver 24 by an ejector screw 134 and an ejector plate 136. The ejector screw 134 is received within a threaded bore (not shown) defined in a base 138 of the fixed ejector 130 to secure the fixed ejector 130 to the internal wall of the upper receiver 24. The ejector plate 136 can be positioned on an outer surface of the upper receiver 24 and define a recess (not shown) for receiving a head of the ejector screw 134 such that the head of the ejector screw 134 is counter sunk into a side of the upper receiver 24. Alternately other fastening techniques can be used to secure the ejector 130 to the inner wall of the upper receiver 24.

Figure 4A:
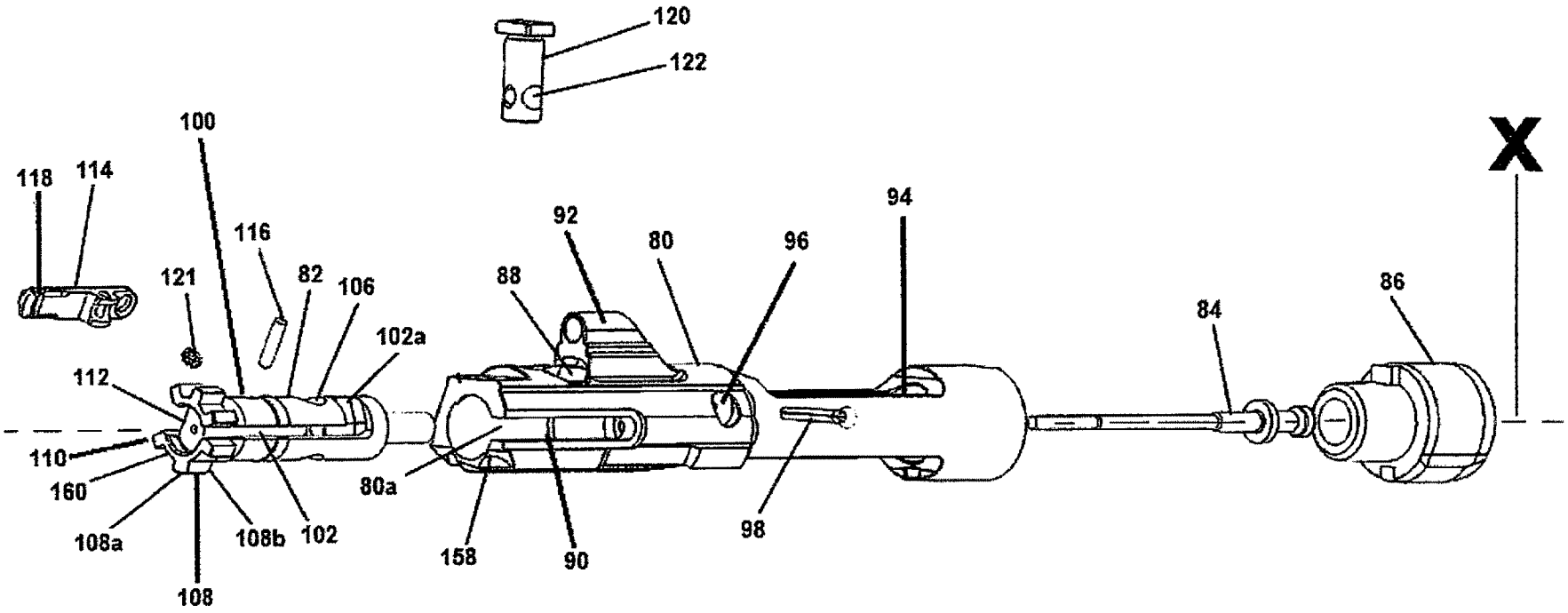
FIG. 4A is an exploded perspective view of the bolt carrier assembly of the operating system shown in FIG. 2.
Figure 4B:
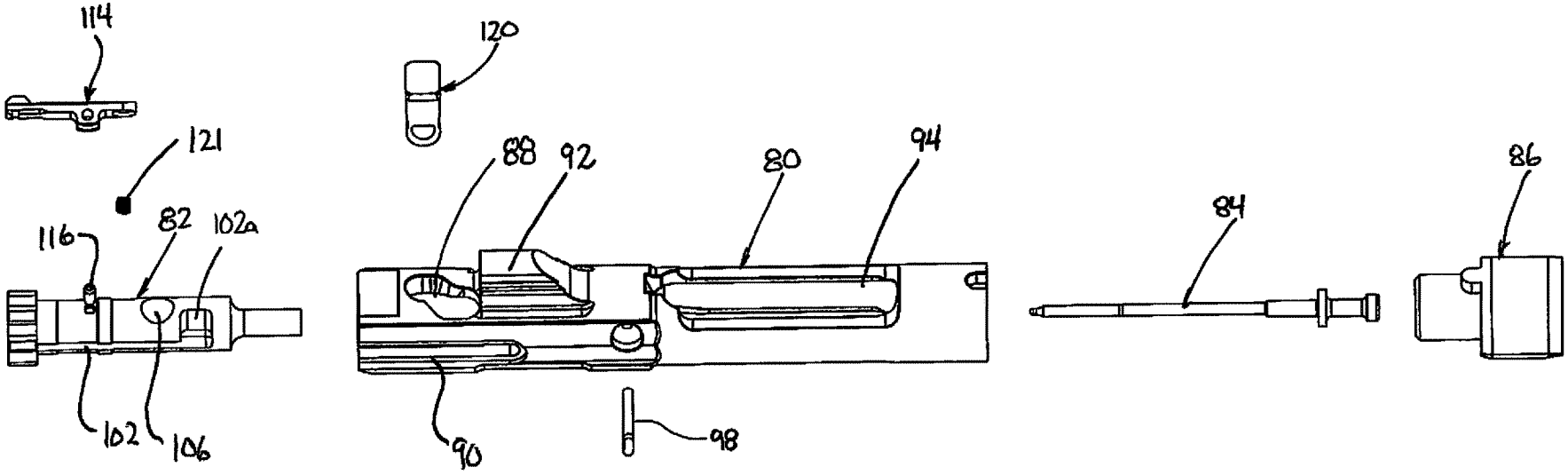
FIG. 4B is an exploded perspective view of the bolt carrier assembly of the operating system shown in FIG. 4A rotated ninety degrees.

Referring to FIGS. 4A and 5, the longitudinal ejector slot 90 of the bolt carrier 80 and the longitudinal ejector slot 102 and ejector pocket 102*a* of the bolt 82 are positioned to receive the fixed ejector 130 as the bolt carrier 80 and the bolt 82 translate within the upper receiver bore 128. The longitudinal ejector slots 90 and 102 are positioned to receive the fixed ejector 130 when the bolt carrier 80 and bolt 82 move axially within the upper receiver bore 128, and the ejector pocket 102*a* of the bolt 82 is positioned to receive the ejector 130 when the bolt 82 rotates in relation to the bolt carrier 80 to the locked position as described below.

Figure 6:
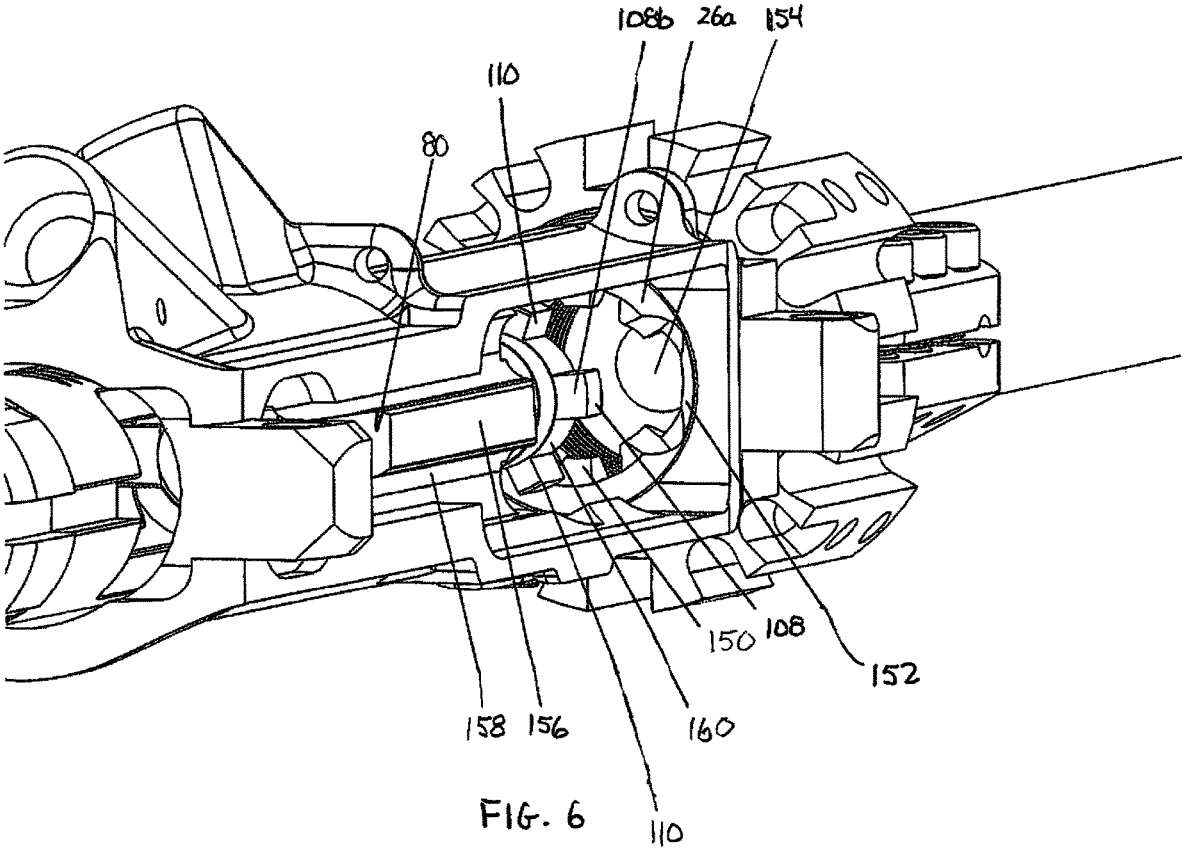
FIG. 6 is an enlarged, perspective view from the bottom of the operating system shown in FIG. 1 looking into the barrel extension and illustrating an interface between the bolt, the bolt carrier, and the barrel extension.

Referring to FIG. 6, the rearward extension 26*a* of the barrel 26 includes extension locking lugs 150. Although not shown, it is envisioned that the locking lugs 150 could be formed on or supported adjacent the forward end of the upper receiver 24 rather on the barrel 26. In addition, the rearward extension 26*a* of the barrel 26 defines a feed ramp 152 and a chamber 154 for receiving a round of ammunition (not shown). The feed ramp 152 is configured with a feed angle and radiused sides to funnel rounds of ammunition stripped from the magazine into the chamber 154 of the firearm. The extension locking lugs 150 are configured to engage the locking lugs 110 of the bolt 82 when the bolt carrier assembly 28 is in its forward most position to lock the breach during firing of the round of ammunition. The bolt carrier 80 defines a guide surface 156 that is positioned to engage the upper most round of ammunition in the magazine 18 (FIG. 8) after a first round has been stripped from the magazine 18 by the forward surface 108*a* of the feed lug 108 of the bolt 82. The guide surface 156 of the bolt carrier 80 is axially aligned with the feed lug 108 when the bolt 82 is in an unlocked position such that the guide surface 156 is positioned to press the upper most round of ammunition supported within the magazine 18 downwardly into the magazine 18 out of the path of the bolt carrier assembly 28 to prevent jamming of the firearm 10. The bolt 82 defines bolt mag cuts 160 that are positioned between the feed lug 108 and the locking lugs 110 and the bolt carrier 80 defines mag cuts 158 to provide the bolt carrier assembly 28 with clearance to pass by the magazine 18.

Figure 7:
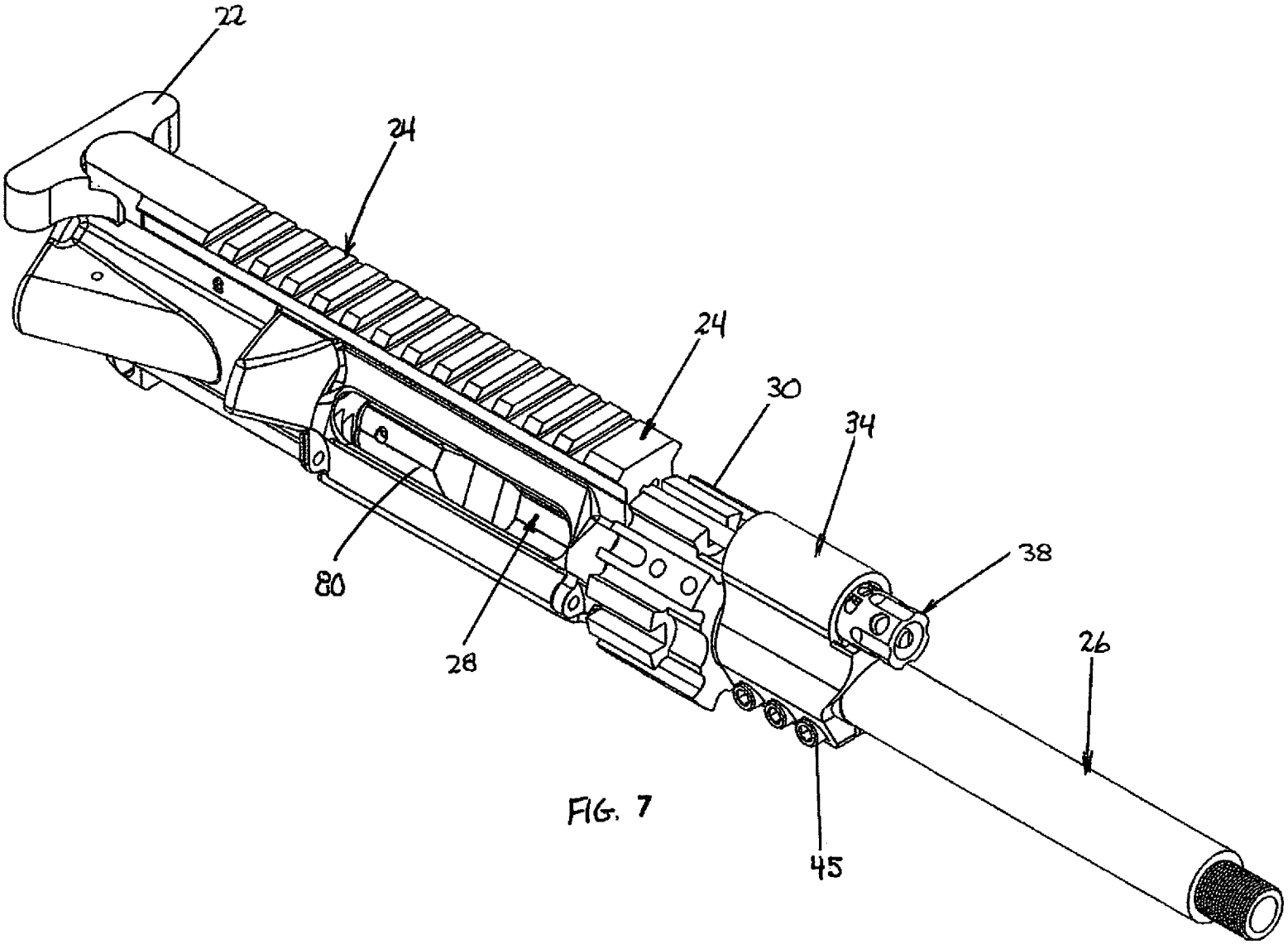
FIG. 7 shows the presently disclosed operating system fully assembled.
Figure 8:
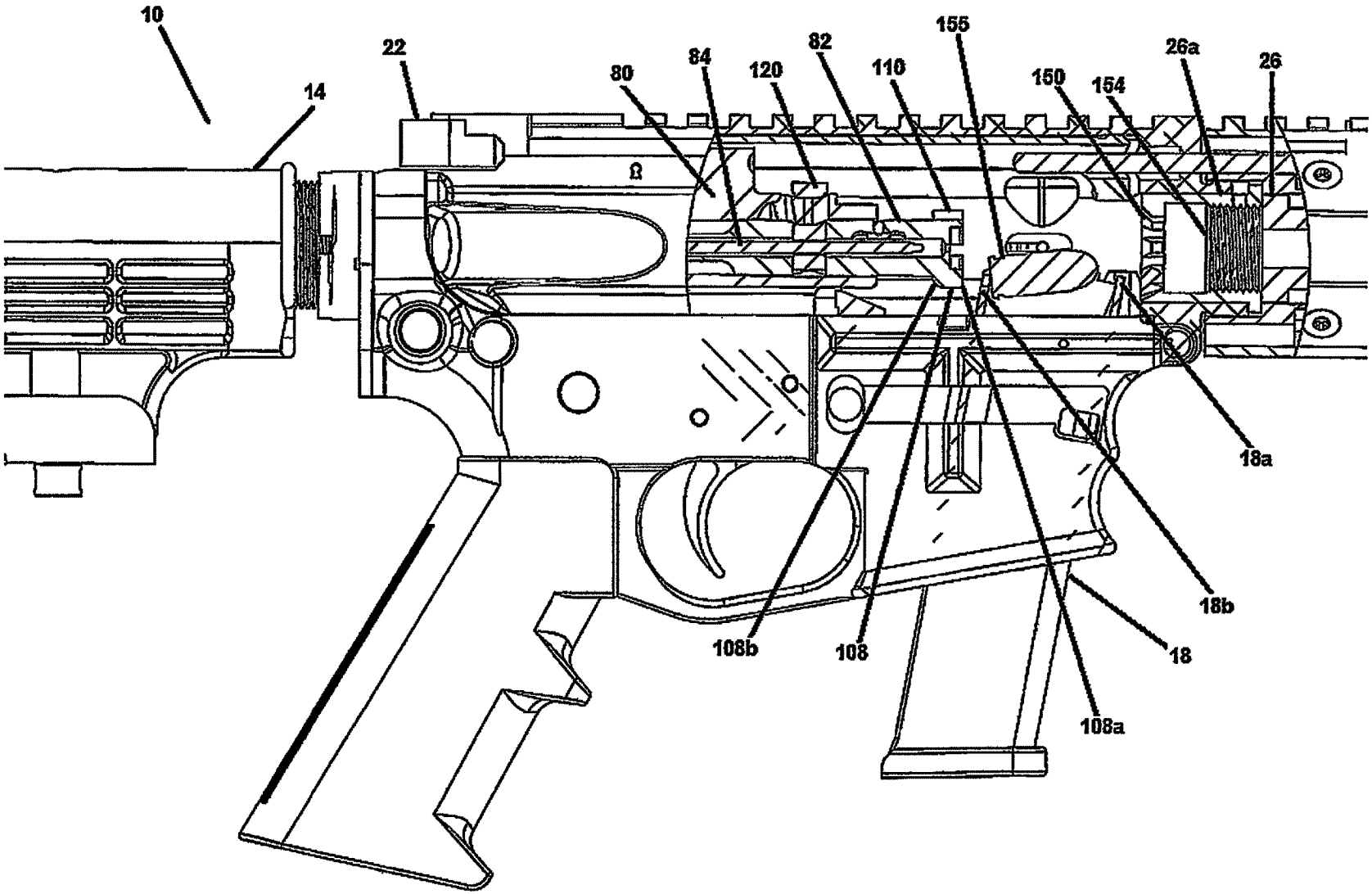
FIG. 8 is a side, partial cross-sectional view of the firearm of FIG. 1 including the operating system of FIG. 2A.

Referring to FIGS. 2B, 7 and 8, in use, a round of ammunition is chambered by pulling the charging handle 22 rearwardly as is known in the art to retract the bolt carrier assembly 28 rearward and position the bolt 82 rearward of an rearward end 18*b* (FIG. 8) of the magazine 18. Releasing the bolt carrier assembly 28 allows the forward face of the feed lug 108 of the bolt 82 to strip the upper most round of ammunition 155 from the open end 18*a* of the magazine 18. As the feed lug 108 strips the round of ammunition from the magazine 18, the feed ramp 152 of the barrel extension 26*a* directs the round into the chamber 154 (FIG. 6) of the barrel extension 26*a*. When the round of ammunition is chambered, the bolt 82 is in its forward most position in which the locking lugs 110 of the bolt 82 have passed between and forwardly of the locking lugs 150 of the barrel extension 26*a* and the bolt 82 abuts the rearward end of the barrel extension 26*a*. When this occurs, continued axial movement of the bolt carrier 80 in relation to the bolt 82 causes the cam pin 120 to move within the cam pin slot 88 of the bolt carrier 80 as the bolt carrier 80 moves axially toward its forward most position. Movement of the cam pin 120 within the cam pin slot 88 causes the bolt 82 to rotate in relation to the bolt carrier 80 and the barrel extension 26 such that the extension locking lugs 150 of the barrel extension 26*a* inter-lock with the locking lugs 110 of the bolt 82 to temporarily lock the bolt 82 from moving rearwardly within the upper receiver 24. In the locked position of the bolt 82, the ejector 130 is received within the ejector pocket 102*a* of the bolt 82. The recess 122 (FIG. 4A) of the cam pin 120 provides clearance for the ejector 130 as the bolt 82 moves axially through and rotates within the upper receiver 24.

Referring also to FIG. 2B, when the firearm 10 is subsequently fired and the piston 44 of the piston op-rod 20 is acted upon by discharge gases 70, the discharge gases 70 drive the op-rod 36 rearward to move the bolt carrier 80 rearwardly. As the bolt carrier 80 is driven rearwardly by op-rod 36, the locking lugs 150 of the barrel extension 26, which are interlocked with the locking lugs 110 of the bolt 82, initially prevent rearward axial movement of the bolt 82 within the upper receiver 24. This causes the bolt carrier 80 to move axially in relation to the bolt 80. When this occurs, the cam pin 120 once again moves within the cam pin slot 88 of the bolt carrier 80 to rotate the bolt 82 in relation to the barrel extension 26*a*. As the bolt 82 is rotated in relation to the barrel extension 26*a*, the bolt locking lugs 110 of the bolt 82 are unlocked from engagement with the locking lugs 150 of the barrel extension 26*a* to allow delayed axial movement of the bolt 82. Simultaneously, the guide surface 156 of the bolt carrier 80 engages the upper most round of ammunition (not shown) within the magazine 18 to urge the rounds within the magazine 18 downwardly. As the guide surface 156 of the bolt carrier 80 urges the rounds within the magazine 18 downwardly, the tapered rear surface 108 *b* (FIG. 8) of the feed lug 108 travels rearward over the rounds to reduce the likelihood of malfunction. The tapered rear surface 108*b* of the feed lug 108 of the bolt 82 allows the feed lug 108 to slide over the upper most round of ammunition 155 within the magazine 18 as the bolt 82 moves rearward within the upper receiver 24. By providing a tapered surface 108*b* on the feed lug 108, the likelihood that the bolt 82 will snag a round of ammunition and jam the firearm 10 is minimized. The guide surface 156, the carrier mag cuts 158, and the bolt mag cuts 160 are configured to provide clearance for the bolt carrier assembly 28 to pass over pistol caliber magazines 18.

As movement of the bolt carrier 80 continues rearward, a spent casing (not shown) of a previously fired round of ammunition is pulled free from the chamber 154 by the extractor 114 and pitched clear of ejection port 128*a* of the upper receiver 24 by the ejector 130. As discussed above, the extractor 114 includes an annular rib 118 that is urged into engagement with the rim of a spent casing of a round of ammunition to grip the spent casing. As the bolt carrier 80 and bolt 82 move rearwardly within the upper receiver 24, the ejector 130 passes through the longitudinal ejector slots 90 and 102 of the bolt carrier 80 and the bolt 82, respectively, into engagement with the spent casing to eject the spent casing from the ejection port 128*a* of the upper receiver 24.

Once the bolt carrier 80 has reached full throw i.e., its rearward most position, the bolt carrier 80 is returned to battery by a recoil spring (not shown) supported in the lower receiver 16 (FIG. 1). As the bolt 82 and bolt carrier 80 are returned forward by the recoil spring, the feed lug 108 of the bolt 82 engages a live round of ammunition from within the magazine 18. Once again, as the bolt 82 moves forward, the guide surface 156 of the bolt carrier 80 traps succeeding rounds of ammunition within the magazine 18 to prevent malfunction while the feed lug 108 of the bolt 82 carries a live round of ammunition stripped from the magazine 18 forward up the feed ramp 152 of the barrel extension 26*a* and into the chamber 154. After the live round is positioned within the chamber 154, the bolt locking lugs 110 again rotate as described above and interlock with the locking lugs 150 of the barrel extension 26*a* to complete one cycle of the firearm's action.

As discussed above, the locked breech rotating bolt pistol caliber operating system 10 can be retro fitted for existing firearms and is compatible with commonly available AR-15 type lower receivers that utilize ubiquitous pistol magazines.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. For example, the locking lugs on the rearward end of the barrel extension could be formed on the inner wall of the upper receiver. As well, one skilled in the art will appreciate further features and advantages of the system based on the above-described embodiments. Accordingly, the present disclosure is not to be limited by what has been particularly shown and described, except as indicated by the appended claims.

What is claimed is:

1. A firearm comprising:

an upper receiver including an internal wall defining a bore and an ejection port communicating with the bore;

a bolt carrier assembly including a bolt carrier and a bolt, the bolt carrier assembly being movable within the bore of the upper receiver between rearward-most and forward-most positions, the bolt being supported on the bolt carrier for axial and rotatable movement in relation to the bolt carrier, the bolt defining a longitudinal slot and an ejector pocket positioned transversely of the longitudinal slot and communicating with the longitudinal slot, the bolt having a forward end including one or more first locking lugs;

one or more second locking lugs supported on the upper receiver adjacent a forward end of the receiver, wherein the bolt is rotatable in relation to the bolt carrier from an unlocked position to a locked position in which the one or more first locking lugs are interlocked with the one or more second locking lugs; and an ejector fixedly supported within the bore of the upper receiver, the ejector having an angled forward face that is positioned to eject spent casings towards the ejection port of the upper receiver, the ejector being received within the ejector pocket of the bolt when the bolt is in the locked position.

2. The firearm of claim 1, further including a barrel, wherein the barrel is supported on a forward end of the upper receiver, the barrel having a rearward end supporting the one or more second locking lugs.

3. The firearm of claim 2, further including a cam pin, wherein the bolt defines a cam pin bore and the bolt carrier defines a cam pin slot, the cam pin extending through the cam pin bore and the cam pin slot to couple the bolt to the bolt carrier.

4. The firearm of claim 3, wherein the cam pin bore is configured to fixedly receive the cam pin and the cam pin slot is configured to allow axial and transverse movement of the cam pin within the cam pin slot such that movement of the cam pin through the cam pin slot causes the bolt to move axially and rotatably in relation to the bolt carrier.

5. The firearm of claim 1, further including a barrel supported on the upper receiver.

6. The firearm of claim 5, further including a gas block supported on the barrel, a gas plug, and an piston op-rod, the piston op-rod including a piston and a rod extending rearward from the piston, the gas block defining a gas plug bore and a barrel bore, the barrel being received within the barrel bore, the piston of the op-rod being received in a rearward end of the gas plug bore and the gas plug being received within a forward end of the gas plug bore, wherein the rod extends from the piston of the piston op-rod and engages the bolt carrier assembly.

7. The firearm of claim 6, wherein the barrel defines a gas aperture and the gas block defines a gas port, the gas port extending between the gas plug bore and the barrel bore and registering with the gas aperture.

8. The firearm of claim 7, wherein the piston of the piston op-rod and the gas plug define a chamber within the gas plug bore, the gas port communicating with the chamber, wherein discharge gases produced by firing a round of ammunition from the firearm flows from the barrel, through the gas aperture and the gas port into the chamber, the discharge gases in the chamber causing rearward movement of the piston op-rod and corresponding rearward movement of the bolt carrier assembly.

9. The firearm of claim 8, further including gas rings supported about the gas plug and the piston of the op-rod, the gas rings providing a hermetic seal between the gas plug and piston and the gas block bore.

10. The firearm of claim 6, wherein the gas block defines a slot and the gas plug defines a boss, the boss being received within the slot to couple the gas plug to the gas block.

11. The firearm of claim 10, wherein the slot is configured to rotatably receive the boss.

12. The firearm of claim 11, wherein the gas block slot defines a detent hole and the gas plug supports a detent assembly including a detent that is received in the detent hole to retain the boss within the slot.

13. The firearm of claim 1, wherein the barrel includes a barrel extension defining a chamber, the barrel extension extending from the barrel and being secured to the upper receiver, the one or more second locking lugs being supported within the barrel extension.

14. A firearm comprising:

an upper receiver including an internal wall defining a bore and an ejection port communicating with the bore;

a bolt carrier assembly including a bolt carrier and a bolt, the bolt carrier assembly being movable within the bore of the upper receiver between rearward-most and forward-most positions, the bolt being supported on the bolt carrier for axial and rotatable movement in relation to the bolt carrier, the bolt having a forward end including one or more first locking lugs;

one or more second locking lugs supported on the upper receiver adjacent a forward end of the receiver, wherein the bolt is rotatable in relation to the bolt carrier from an unlocked position to a locked position in which the one or more first locking lugs are interlocked with the one or more second locking lugs; and an ejector fixedly supported within the bore of the upper receiver, the ejector having an angled forward face that is positioned to eject spent casings towards the ejection port of the upper receiver;

wherein the bolt includes a feed lug having a tapered rear surface and the firearm further includes pistol caliber magazine, the feed lug being positioned to strip an upper most round of ammunition from the pistol caliber magazine and deliver the upper most round to the chamber, the tapered rear surface being positioned to engage and pass over the upper most round of ammunition during rearward movement of the bolt within the bore of the upper receiver.

15. The firearm of claim 14, wherein the bolt carrier defines a longitudinal axis and the tapered rear surface of the feed lug defines an angle β with the longitudinal axis, wherein β is between 15 degrees and 45 degrees.

16. The firearm of claim 15, wherein β is between 25 degrees and 35 degrees.

17. The firearm of claim 16, wherein β is 30 degrees.

18. The firearm of claim 1, wherein the bolt carrier of the bolt carrier assembly includes a round guide that is positioned to engage a round of ammunition within a pistol caliber magazine supported on the firearm.

19. The firearm of claim 1, wherein the bolt carrier includes mag cuts to allow the bolt carrier to clear a pistol caliber magazine during movement of the bolt carrier assembly between its forward most and rearward most positions.

20. The firearm of claim 1, wherein the bolt and the bolt carrier include a longitudinal slot positioned to receive the ejector during movement of the bolt carrier assembly between its forward most and rearward most positions.

21. The firearm of claim 20, wherein the bolt defines an ejector pocket, the ejector pocket being configured to receive the ejector when the bolt is rotated to the locked position to facilitate rotation of the bolt within the bore of the upper receiver to the locked position.

22. The firearm of claim 13, wherein the barrel extension includes a feed ramp that works in conjunction with the feed lug of the bolt to strip rounds of ammunition from a pistol magazine and direct the rounds into the chamber.

23. The firearm of claim 14, wherein a forward surface of the feed lug has a chamfered lower edge having a radius of curvature of 0.020 of an inch to 0.040 of an inch.

* * * * *